US006274077B1

(12) United States Patent
Hur et al.

(10) Patent No.: US 6,274,077 B1
(45) **Date of Patent: *Aug. 14, 2001**

(54) MANUFACTURING METHOD FOR A BUFFER AND HEAT-INSULATING MATERIAL MADE OF A FOAMED CELLULOSE SUBSTANCE

(75) Inventors: Bang-Uk Hur; Yoo-Byung Bark, both of Seoul (KR)

(73) Assignee: Daewon Paptin Foam Co., Ltd., Kyungki-Do (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/996,213

(22) Filed: Dec. 22, 1997

(30) Foreign Application Priority Data

Jun. 10, 1997 (KR) ..... 97-23894

(51) Int. Cl.[7] ..... B29C 44/02
(52) U.S. Cl. ..... 264/420; 264/54; 264/338
(58) Field of Search ..... 264/415, 420, 264/54, 338; 249/78

(56) References Cited

U.S. PATENT DOCUMENTS

| | | | | |
|---|---|---|---|---|
| 150,844 | * | 5/1874 | Eastwick et al. | 426/551 |
| 174,890 | * | 3/1876 | Arnois | 426/562 |
| 235,615 | * | 12/1880 | Avery | 426/562 |
| 3,564,199 | * | 2/1971 | Blaha | 219/205 |
| 3,748,439 | * | 7/1973 | Ting et al. | 219/540 |
| 3,940,591 | * | 2/1976 | Ting | 219/544 |
| 5,344,595 | * | 9/1994 | Aoki et al. | 264/417 |
| 5,360,586 | * | 11/1994 | Wyatt et al. | 264/54 |
| 5,707,579 | * | 1/1998 | Habelski et al. | 264/417 |

FOREIGN PATENT DOCUMENTS

| | | | | |
|---|---|---|---|---|
| 62-174112 | * | 7/1987 | (JP) | 249/78 |

* cited by examiner

*Primary Examiner*—Allan R. Kuhns
(74) *Attorney, Agent, or Firm*—Pillsbury Winthrop LLP

(57) ABSTRACT

The present invention relates to an improved manufacturing method of a buffer and heat-insulating material made of foamed cellulose substance, wherein cellulose material is heated homogeneously in a microwave oven to be foamed homogeneously and thus when dried the foamed product is not deformed, whereby an excellent buffer and heat-insulating material is obtained.

4 Claims, No Drawings

MANUFACTURING METHOD FOR A BUFFER AND HEAT-INSULATING MATERIAL MADE OF A FOAMED CELLULOSE SUBSTANCE

DETAILED DESCRIPTION OF THE INVENTION

This invention relates to an improved manufacturing method of a buffer and heat-insulating material made of foamed cellulose substance.

In packing of goods, a buffer material is an essential subsidiary material to prevent damage and deformation of goods during transportation and preservation. Such buffer material should have elasticity or the property that it absorbs impacts. Usually, foamed plastic substances have been used as a buffer material. For example, they may include plastic materials obtained by foaming ordinary plastics such as polyethylene(PE), polypropylene(PP), ethylene vinyl acetic acid copolymer(EVA), polystyrene(PS), denatured EVA, soft PVC, phenoxy resin, butadiene resin; and elastic substances of themselves of natural rubber, rubber of SBR system, thermoplastic rubber of styrene-butadiene system, butadiene rubber(BR), isoprene rubber(IR), ethylene prophylene copolymer rubber(EMP), polychloroprene rubber (CR), butyl rubber(IIR), urethane rubber, silicone rubber, polysulfide rubber, acryl rubber, chlorosulfonated styrene rubber, chlorinated polyethylene rubber, epichlorohydrin rubber, propylene oxide rubber, ethylene vinyl acetate rubber, thermoplastic rubber or their foamed products. Among them polyethylene foam and polystyrene foam have been used widely as they are cheap.

Though these plastic substances or rubbers have excellent buffering properties, they occur environmental pollution as they cannot decay in the natural environment and toxic gas is produced when burned, and therefore the use of plastic foams, natural or synthetic rubbers is prohibited in developed countries. Moreover, in the near future, under Green Round, their use should be prohibited in the whole world.

On the other hand, in order to solve these problems, pulp or cellulose substance is foamed directly to give a buffer material. However, these buffer materials have been limited in the use since their absorbability of impacts is so low that their role as the buffer materials cannot be carried out successfully.

For a long time, the present inventors have studied about buffer and heat-insulating materials and found the fact that if cellulose substance is wet-foamed with normal foaming agents and normal water-soluble adhesives and dried, the foamed cellulose substance has the increased volume ranging from 120% to 500% of the original volume thereof and whereby has the remarked absorbability against impacts, and therefore is very useful as a buffer material, and also a great number of pores are formed inside by foaming, whereby heat-insulating effects is very high. Accordingly, an application disclosing the prescribed invention by the inventors have been already filed in Korea as Korean patent application No. 94-4703.

In addition, a buffer and heat-insulating material prepared using the prescribed method may decay faster than normal cellulose substance in the nature since a great number of pores are formed inside, whereby it does not occur any pollution problem, can prevent pollution by recycling the waste resources. Accordingly, such buffer material may be permitted under the Green Round as so-called "green products" and therefore can be used widely as a subsidiary material for packing of goods.

The above-mentioned Korean patent application No. 94-4703 discloses a manufacturing method of the buffer and heat-insulating material made of foamed cellulose substance, wherein the cellulose substance is foamed together with adhesives and foaming agents and then dried. In more detail, according to the above invention, waste paper was beaten in water and dehydrated till to the water content of about 30 wt %. Then, adhesives dissolved in water and forming agents were mixed with the beaten waste paper, and the whole mixture was preheated to about 85° C. and injected into a mould heated up to about 270–300° C. and foamed. Then, the foamed material was dried in a drying furnace to give the foamed product.

However, the foamed product manufactured by the above method has still some problems as follows:

1. It may not be homogeneously foamed because heat is ununiformly applied when pre-heated cellulose premix is injected into a mould and foamed.
2. Fully foamed portion of the product has the sufficient buffering property but the other portion where heat is poorly applied has poor elasticity, and thus such irregularly foamed product is not suitable for being used a buffer material for packing of goods.
3. Such irregularly foamed product may be deformed when dried and thus it cannot be used as a buffer.

In order to solve the above problems the present inventors have further studied and now completed the present invention.

Therefore, an object of the invention is to provide an improved manufacturing method of a buffer and heat-insulating material which is obtained by foaming cellulose substance.

More particularly, the object of the invention is to provide an excellent buffer and heat-insulating material made of foamed cellulose substance which is homogeneously foamed by heating homogeneously in a microwave oven and thus not deformed when dried.

Hereinafter, the present invention will be explained in more detail.

Raw materials of cellulose substance used in the invention may include normal cellulose, pulp or waste paper, and the like.

Adhesives used in the invention may include starch, sodium carboxymethyl cellulose, ethyl cellulose, methyl cellulose, sodium alginate, casein, gelatin, polyvinyl alcohol (PVA), polyvinyl acetate(PVAc) and other conventional water-soluble adhesives and may be used independently or as a mixture thereof. The adhesives used may be of various amounts depending on the kinds of adhesives and their adhesive force, but usually of an amount ranging from 0.1 to 20 wt % to the total weight.

Foaming agents used in the invention may include organic foaming agents such as, for example, azodicarbonamide (ADCA), azobisformamide(ABFA), azobisisobutyronitrile (AIBN), N,N'-dinitrosopentamethylene tetramine(DPT), p-toluenesulfonyl hydrazide(TSH), p,p'-oxybis (benzenesulfonyl hydrazide)(OBSH); and inorganic foaming agents such as, for example, ammonium carbonate, sodium hydrogen carbonate, and may be used independently or as a mixture thereof. The foaming agents used may be of an amount ranging from 0.5 to 20 wt % to the total weight.

Raw cellulose substance is beaten with addition of water, and then dehydrated till to the water content of 20–30 wt %, preferably, about 25 wt %. Such cellulose substance may be preferably used in the range of 50~80 wt % to the total weight.

During manufacturing process, the water content of the whole mixture may be in the range of 10~30 wt %, preferably about 25%wt.

A mould is one of the most important in the present invention. When microwave is irradiated through the mould, the mould has to be endurable, allow permeation of microwave to the high degree and released easily from foamed products. Polycarbonate as mould material is most preferred as it is endurable against irradiated microwave and has good mould-releasing property.

In addition, in order to increase the mould-releasing property, it may be possible that a mould-releasing agent such as silicone-type mould-releasing agent is applied on the inner surface of the mould and then the premix is injected.

Then, foaming process is carried out in a microwave oven. In order to prevent leakage current, the device for irradiation of microwave may be designed in such a way that microwave is irradiated within the completely sealed space, or alternatively the mixture to which microwave is irradiated may be put in or out freely into or from the oven by opening out both the inlet and outlet by means of a conveyer belt. Therefore, the cellulose mixture can be sure of being foamed homogeneously by microwave.

Then, the foamed product is dried by using the P.T.C. (Positive Temperature Coefficiency Resistor) in a store, which may maintain the inside temperature regularly, rather than by using conventional heating methods. The drying is carried out preferably at the temperature ranging from 50 to 100° C.

Finished products may be stored not to be deformed during preservation.

The process by the present invention will be further explained as follows:

1. Pulping

Conventional pulp being used for the preparation of paper may be used as it is without any treatment, or any paper products containing cellulose material such as newspapers, magazines, waste papers and the like may be mixed and pulped. In this step no chemical reagent is added.

2. Dehydration

The waste paper obtained by pulping is dehydrated to be the water content of about 25 wt % by using a centrifugal dehydrator.

3. Mixing

The raw material obtained by dehydration is mixed with adhesives and foaming agents selected from the above-mentioned adhesives and foaming agents. by adding the adhesives cellulose substance may be bridged, and by adding the foaming agents a great number of pores is formed within cellulose substance so that the product may be endowed with excellent buffer and heat-insulation properties.

4. Preheating

The mixture obtained from mixing is preheated. This preheating may give improvements in mould-releasing, foaming and drying of the product. An apparatus for preheating has pipelines within an oil tank and the mixed raw material passes through the pipelines. The preheating is carried out preferably at the temperature of 50–100° C.

5. Injection

The injection is to feed the preheated raw material into a mould. The raw material is injected into the mould by quantitatively predetermined feeding system in considering with the type of both raw material and product. The mould, preferably, may be made of polycarbonate as mentioned above. In addition, in order to increase the mould-releasing property, a mould-releasing agent of silicone-type may be applied on the inner surface of the mould.

6. Microwave Irradiation

In order to prevent the leakage of microwave, microwave may be irradiated within the completely sealed space, or alternatively the product may be allowed to put in or out freely into or from the microwave oven through both opened inlet and outlet by means of a conveyer belt.

7. Drying

Rather than to use conventional heating methods, it is desirable to use the P.T.C.(Positive Temperature Coefficiency Resistor) within a store which may adjust the drying temperature regularly, the temperature being preferably in the range of 50–100° C.

8. Storage

Finished products have to be stored not to be deformed.

Hereinafter, the present invention will be explained in more detail with examples.

EXAMPLE 1

1 kg of waste paper was put into 600 ml of water and beaten. The beaten waste paper was dehydrated till to the water content of about 25 wt %. Respectively, about 20 g of gelatin was dissolved in water of 60° C. till to the concentration of 30 wt %, and 20 g of sodium carboxymethyl cellulose(sodium CMC) was dissolved in water till to the concentration of 30 wt %. To the mixture of gelatin solution and sodium CMC solution, 100 g of azobisisobutyronitrile (AIBN) as a foaming agent was added, and then the beaten waste paper was added thereto and the whole mixture was preheated to about 95° C. The preheated mixture was injected into a mould made of polycarbonate which was formed into any required shape. The mould filled with the premix was put into a microwave oven and treated with microwave radiation to be foamed homogeneously. The mould was taken out from the oven and dried by means of the P.T.C. at the temperature of 70±5° C. to obtain the foamed product.

EXAMPLE 2

The preheated premix prepared by the method as described in example 1, was injected into a polycarbonate mould applied with silicone mould-releasing agent. The mould was carried on an operating conveyer belt within a microwave oven which had both opened inlet and outlet and microwave was radiated thereto to foam the premix homogeneously. Then the foamed product was obtained by drying it by the method as described in example 1.

What is claimed is:

1. A method of producing a foamed heat-insulating material which is comprised of a cellulose substance that functions as a buffer material comprising the following steps:

a) heating a cellulose or waste paper material;

b) dehydrating said material to obtain a material having a water content of about 25 weight percent;

c) mixing the dehydrated material with adhesives and foaming agents;

d) preheating the resulting premix to a temperature of 50–100° C.;

e) injecting the preheated mixture into a mold;

f) treating the injected material with microwave irradiation to produce a homogenous foam material; and g) drying the resultant foam material by use of P.T.C. (positive temperature co-efficiency resistor) at a temperature of 50–100° C.

2. The method of claim 1 wherein the mold is made of polycarbonate, the adhesives are selected from the group consisting of: starch, sodium carboxymethyl cellulose, ethyl cellulose, methyl cellulose, sodium alginate, casein, gelatin, polyvinyl alcohol, polyvinyl acetate and mixtures thereof, and the foaming agents are selected from the group consisting of azodicarbonamide (ADCA), azobisformamide (ABFA), azobisisobutyronitrile (AIBN), N,N'-dinitroso pentamethylene tetramine(N,N'-DPT), p-toluenesulfonylhydrazide(p-TSH), p,p'-oxybis (benzenesulfonylhydrazide)(OBSH), ammonium carbonate, sodium hydrogen carbonate and mixtures thereof.

3. The method of claim 1 wherein the mold is made of polycarbonate and to the inner surface thereof is applied a silicone-type mold-releasing agent.

4. The method of claim 2 wherein the mold is made of polycarbonate and to the inner surface thereof is applied a silicone-type mold-releasing agent.

* * * * *